United States Patent [19]

Janvrin

[11] B 3,986,522

[45] Oct. 19, 1976

[54] HYDRAULIC CONTROL VALVE

[75] Inventor: Robert B. Janvrin, Kalamazoo, Mich.

[73] Assignee: General Signal Corporation, Rochester, N.Y.

[22] Filed: Oct. 15, 1974

[21] Appl. No.: 514,687

[44] Published under the second Trial Voluntary Protest Program on January 27, 1976 as document No. B 514,687.

[52] U.S. Cl. ..... 137/596.12; 91/464; 137/596; 137/625.68

[51] Int. Cl.[2] ..... F15B 13/04

[58] Field of Search ..... 91/436, 446, 447, 464; 137/596, 596.12, 596.2, 625.68, 596.13

[56] References Cited

UNITED STATES PATENTS

| | | | |
|---|---|---|---|
| 2,916,050 | 12/1959 | Ruhl | 137/625.68 |
| 2,949,097 | 8/1960 | Vander Kaay | 137/625.68 |

*Primary Examiner*—Alan Cohan
*Assistant Examiner*—Gerald A. Michalsky
*Attorney, Agent, or Firm*—Harold Huberfeld; Jeffrey S. Mednick

[57] ABSTRACT

A hydraulic control valve comprises a housing having inlet and exhaust ports, first and second motor ports, and passageways interconnecting the ports. A shiftable valve element has an internal flow passage and four operative positions for controlling flow through said passageways. In the first position, the inlet and exhaust ports are interconnected and each motor port is isolated from the other ports. In the second and third positions, the inlet port is isolated from the exhaust port and is connected with the first and second motor ports, respectively, while the exhaust port is connected with the second and first motor ports, respectively. In the fourth position, the two motor ports are interconnected and this interconnection is in restricted communication with the exhaust port. A check valve is located in the internal flow passage for preventing flow from the first motor port to the exhaust port when the valve element is moved between the first and second positions. The improvement comprises a valve component associated with the shiftable valve element for preventing fluid communication between the second motor port and the exhaust port when the shiftable valve element is moved between the first and third positions.

14 Claims, 6 Drawing Figures

HYDRAULIC CONTROL VALVE

BACKGROUND OF THE INVENTION

While the invention is subject to a wide range of applications, it is especially suited for use in a hydraulic circuit for actuating double-acting motors and will be particularly described in that connection. A typical device of this type is an open-center valve which, together with a reservoir, a pump, and a double-acting differential area piston motor, form a control system for positioning the earth-moving bucket of a front-end loader. Frequently, these valves have four operative positions, namely: a "raised" position in which the pump and reservoir are connected with opposite sides of the fluid motor for raising the bucket; a "power-down" position in which the pump and reservoir connections with the fluid motor are reversed for lowering the bucket; a "neutral" or "hold" position in which the connection with each side of the fluid motor is blocked and the pump is unloaded to the reservoir to maintain the bucket in a fixed position; and a "float" position in which both sides of the fluid motor are placed in communication with the pump and an unloading path is established between the pump and the reservoir. In the float position, two types of operation are provided. In one type, the bucket floats down from the raised position without cavitation and faster than the power-down rate. At this time, the pump flow is available for other functions. The other operation permits the bucket being moved across the ground to float up and down according to the contour of the ground.

A hollow spool design is very beneficial for a control valve including the float position. For instance, as the bucket floats down, more fluid may leave the head end of the motor than is drawn into the rod end. Loss of fluid in the rod end can cause cavitation. By connecting the cylinder ports together and bleeding off the excess flow to tank, a positive pressure is maintained at the cylinder ports to drive oil back to the rod end and thereby eliminate cavitation. During the movement of the hollow spool valve from the raise position to the hold position, fluid can pass from one side of the motor into the reservoir. This results in the bucket dropping from its desired position. It is a well-known expedient, as shown in U.S. Pat. No. 2,994,346 to Ruhl to place a load check valve in the internal flow passage of the valve to prevent this backflow.

When the front loader is used for grading, the power-down position is used to lower the bucket. This may actually cause the wheels of the machine to be raised from the ground. The weight of the machine puts a large load on the motor cylinder. When the desired position of the bucket is reached, the control valve is moved to the hold position. During this movement, high pressure fluid from the cylinder can pass into the reservoir and permit undesired movement of the bucket. Since it is beneficial to provide a hollow spool valve for the float position, a load check valve as used in the raise position, cannot be incorporated in the control valve as it eliminates the float position.

A need to provide a hollow spool control valve with a float position and a load check valve for both the raise and power-down positions is recognized. A new load check valve which can satisfy this need may also be used for applications other than in a control valve.

It is an object of the present invention to provide a hydraulic control valve which includes an anti-backflow check valve for the power-down position.

It is a further object of the present invention to provide a hydraulic control valve which includes a float position without cavitation.

It is a further object of the present invention to provide a hydraulic control valve which has increased ease of operation.

It is a further object of the present invention to provide a hydraulic control valve which is relatively easy to assemble.

It is a further object of the present invention to provide a load check valve which can direct flow to either an outlet or a bypass opening.

SUMMARY OF THE INVENTION

In accordance with the present invention, a hydraulic control valve comprises a housing having inlet and exhaust ports, first and second motor ports, and passageways interconnecting the ports. A shiftable valve element has an internal flow passage and four operative positions for controlling flow through said passageways. In a first position, the inlet and exhaust ports are interconnected and each motor port is isolated from the other of said ports. In the second and third positions, the inlet port is isolated from the exhaust port and is connected with the first and second motor ports, respectively, while the exhaust port is connected with the second and first motor ports, respectively. In the fourth position, the two motor ports are interconnected and this interconnection is in restricted communication with the exhaust port. A check valve in the internal flow passage prevents flow from the first motor port to the exhaust port when the valve element is moved between the first and second positions. The improvement comprises a valve component associated with the shiftable valve element for preventing fluid communication between the second motor port and the exhaust port when the shiftable valve element is moved from the third position to the first position.

To be more specific, a hydraulic control valve comprises a housing containing a valve bore intersected by seven longitudinally spaced chambers. These chambers include a central exhaust chamber, first and second outer exhaust chambers located on opposite sides of the central exhaust chamber, first and second motor chambers located, respectively, between the central exhaust chamber and the first and second outer exhaust chamber, and first and second supply chambers located, respectively, between the central exhaust chamber and the first and second motor chambers. A shiftable valve element reciprocates in the valve bore and contains an internal passage and six spaced transverse passages which open through the outer peripheral surface of the shiftable valve element. The shiftable valve element has a first position in which it isolates each motor chamber from the other chambers and connects the supply chambers with the central exhaust chamber. In a second position, the first and second transverse passages register, respectively, with the first motor port and first supply chamber. In this position, the fourth and sixth transverse passages register the second motor chamber with the second outer exhaust chamber, respectively, while means carried by the valve element isolate the central exhaust chamber from the supply chambers. In a third position, the first and second transverse passages register, respectively, with the first outer exhaust and first motor chambers. At this time, the fourth and fifth transverse passages register with the second supply chamber and the second motor chamber, respectively, while means carried by the valve element isolate the central exhaust chamber from the supply chambers. In a fourth position, the third and sixth transverse passages register with the first and second motor chambers, respectively, as well as with each other via the internal passage of the valve element. At this time, the fourth transverse passage connects the internal flow passage to the central exhaust chamber to bleed off any excess pressure. A spring biased check valve is located in the internal flow passage of the valve element and is arranged to prevent fluid communication between the first motor chamber and the central exhaust chamber when the valve element is moved from the second position to the first position. Further, a valve component is associated with the shiftable valve element for preventing fluid communication between the second motor chamber and the central exhaust chamber when the shiftable valve element is moved from the third position to the first position.

Also in accordance with the present invention, a valve includes walls defining a housing with two ends. A first position of the housing has a given first internal diameter and a second portion adjacent to the first portion has a second internal diameter greater than the first internal diameter. The housing is closed at one end adjacent the second portion. A hollow valve element is slideably received in the housing and has a first outside diameter which approximates the internal diameter of the first portion and a second outside diameter which approximates the internal diameter of the second portion. A portion of the first outside diameter overlaps a portion of the second internal diameter to form a chamber. A spring is located within the chamber and forces the element toward a closed end of the housing. An outlet opening in the housing wall is adjacent the inlet so that when the outlet opening is between the second outside diameter and the inlet, a fluid from the inlet cannot flow through the outlet opening unless the pressure of the fluid is sufficient to slide the valve element against the spring to expose the outlet opening. A bypass opening is adjacent the second end for receiving fluid from the inlet. The second outside diameter is located between the inlet and the bypass opening. Means are provided for closing the bypass opening when it is desired to bypass the outlet opening.

For a better understanding of the present invention, together with other and further objects thereof, reference is made to the following description, taken in connection with the accompanying drawings, while its scope will be pointed out in the appended claims.

DESCRIPTION OF THE PREFERRED EMBODIMENT

Figures 1, 5, 6:
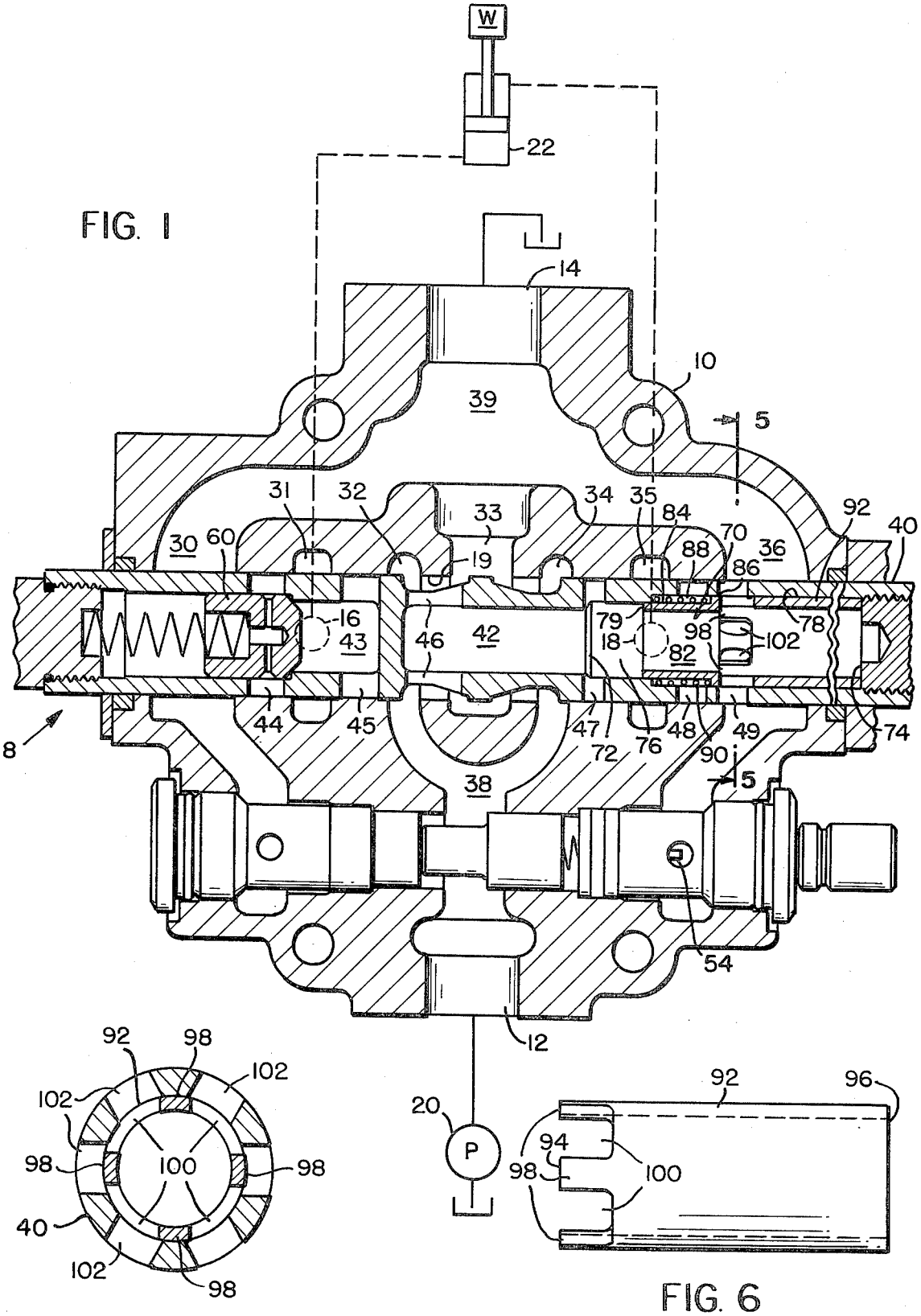
FIG. 1 is a cross-sectional view of the hydraulic control valve showing the shiftable valve element in its neutral position.
FIG. 5 is a sectional view taken on line 5—5 of FIG. 1 illustrating the sleeve in the valve element.
FIG. 6 is a side view of the sleeve.

A hydraulic control valve 8 comprises a housing 10 having inlet and exhaust ports 12 and 14, first and second motor ports 16 and 18, passageways 30 through 36 interconnecting said ports, and a shiftable valve element 40 having internal flow passages 42 and 43. Shiftable valve element 40 has four operative positions for controlling flow through passageways 30 through 36. In a first position, inlet and exhaust ports 12 and 14 are interconnected and each motor port 16 and 18 is isolated from the other ports. In the second and third positions, inlet port 12 is isolated from exhaust port 14 and is connected with first and second motor ports 16 and 18, respectively, while exhaust port 14 is connected with motor ports 18 and 16, respectively. In the fourth position, motor ports 16 and 18 are interconnected and in restricted communication with exhaust port 14. A check valve 60, in the internal flow passage 43, prevents fluid communication between motor port 16 and exhaust port 14 when valve element 40 is moved between the first and second positions. The improvement comprises valve component 70 associated with shiftable valve element 40 for preventing fluid communication between motor port 18 and exhaust port 14 when shiftable valve element 40 is moved between the first and third positions.

Referring to FIG. 1, there is shown a hydraulic control valve in combination with a pump 20 and a motor 22. Hydraulic control valve 8 includes a housing 10 having an inlet port 12, an exhaust port 14, a first motor port 16, a second motor port 18 and a valve bore 19 intersected by seven longitudinally spaced annular chambers 30 through 36. Annular chambers 32 and 34 are connected with inlet port 12 by a branch supply passage 38. Annular chambers 30, 33, and 36 are connected with exhaust port 14 by an exhaust manifold 39. Annular chambers 31 and 35 are connected with motor ports 16 and 18, respectively. As in prior art control valves, such as, for example, the Ruhl patent, a pilot operated relief valve 54 is provided between supply passage 38 and exhaust manifold 39.

Located within slideable valve bore 19 is a shiftable valve element 40 having two internal flow passages 42 and 43. Valve element 40 includes transverse passages 44 through 49 to permit hydraulic fluid to pass from internal flow passages 42 and 43 to chambers 33 through 36. A check valve 60 is located within flow passage 43 to prevent flow from transverse passage 42 towards passage 45.

Internal flow passage 42 contains valve component 70 and includes walls which define a housing. The housing includes a first end 72 and a closed end 74. A first portion 76 of said housing has a given internal diameter. A second portion 78 is adjacent portion 76 and has a larger internal diameter than that of the portion 76. A hollow valve element 82, referred to as a load check valve, is slideably received in flow passage 42. An outside diameter 84 of check valve 82 approximates the internal diameter of portion 76. A second outside diameter 86 of valve 82, referred to as a shoulder, approximates the internal diameter of portion 78. A portion of the outside diameter of portion 76 overlaps a portion of the internal diameter of portion 78 to form a chamber 88. A spring 90, preferably of the compression type surrounds check valve 82 and is located within chamber 88 to bias check valve 82 toward closed end 74. It is also within the scope of the invention to locate a compression type spring in other positions (not illustrated), such as, between first end 72 and end 79 of valve element 82. Further, spring 90 might be of another type, such as an extension spring connected between end 74 and valve element 82 (not illustrated).

Referring to FIGS. 5 and 6, a sleeve member 92 is located in portion 78 of the control valve and has an end 94 for providing an abutment to stop load check valve 82. Sleeve member 92 also includes an end 96 for contacting the closed end 74 of the housing and a plurality of fingers 98 which define openings 100 on end 94. Openings 100 are aligned with a plurality of openings 102 in transverse passageway 49 so that fluid may pass from openings 100 through openings 102 irrespective of the position of the sleeve with respect to the shiftable valve element 40. While four openings 100 and six openings 102 are illustrated in the drawings, any desirable combination of openings may be used.

The unique features of the present invention can be more fully understood from the following description of its typical operation. Assume that a front end loader includes a control valve, of the type shown in FIG. 1, to control a motor 22 for operating a boom attached to a bucket. In the neutral or hold position referred to as the first position, hydraulic fluid from pump 20 enters hydraulic control valve 8 via inlet port 12. The fluid flows through branch supply passage 38, central exhaust chamber 33, exhaust manifold 39, exhaust port 14, and into a reservoir. During this time, motor ports 16 and 18 are isolated from inlet port 12 and exhaust port 14 and therefore do not permit any fluid to leave motor 22. Thus the boom and bucket attached to motor 22 are maintained in a fixed position. One skilled in the art will realize that a plurality of control valve may be connected in series to provide more than one work function at a time.

Figure 2:
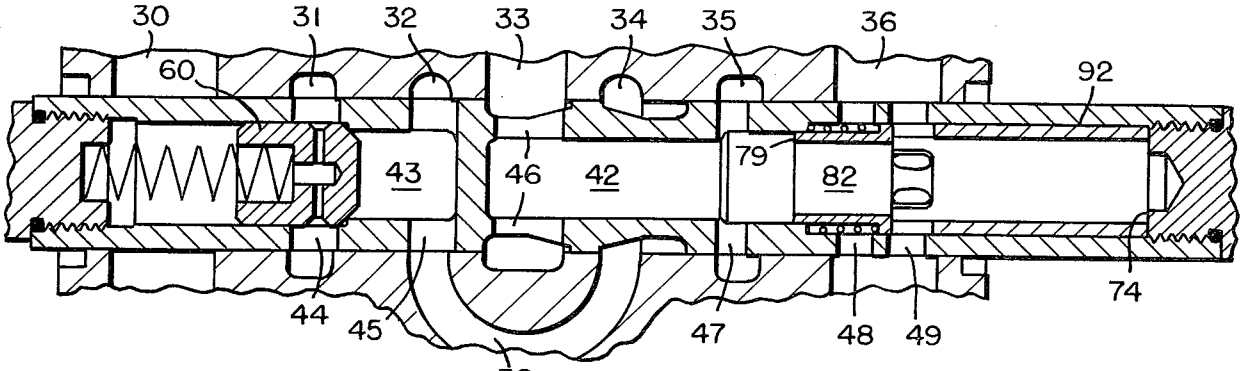
FIG. 2 is a view similar to FIG. 1, but showing the valve element in its raised position.

Assuming that the operator of the machine desires to raise the bucket, he moves shiftable valve element 40 to the raise or second position. Referring to FIG. 2 which illustrates the raise position, hydraulic fluid from supply chamber 32 passes through transverse passage 45 and opens check valve 60 to allow communication through transverse passage 44 into motor chamber 31. The fluid then enters motor port 16 and flows into motor 22 to act against the piston and raise the boom and bucket. During this time fluid from the rod end of motor 22 passes into motor port 18, motor chamber 35, through transverse passage 47, and into internal flow passage 42. The hydraulic fluid can then pass through both transverse passage 46 into central exhaust chamber 33 and through transverse passage 49 into outer exhaust chamber 36.

Once the bucket is at a desired position, valve element 40 is shifted back to its neutral position. During this movement, high pressure fluid in motor chamber 31, created by the weight of the bucket on the head end of motor 22, is prohibited from flowing into supply chamber 32 and central exhaust chamber 33 by check valve 60.

Figure 4:
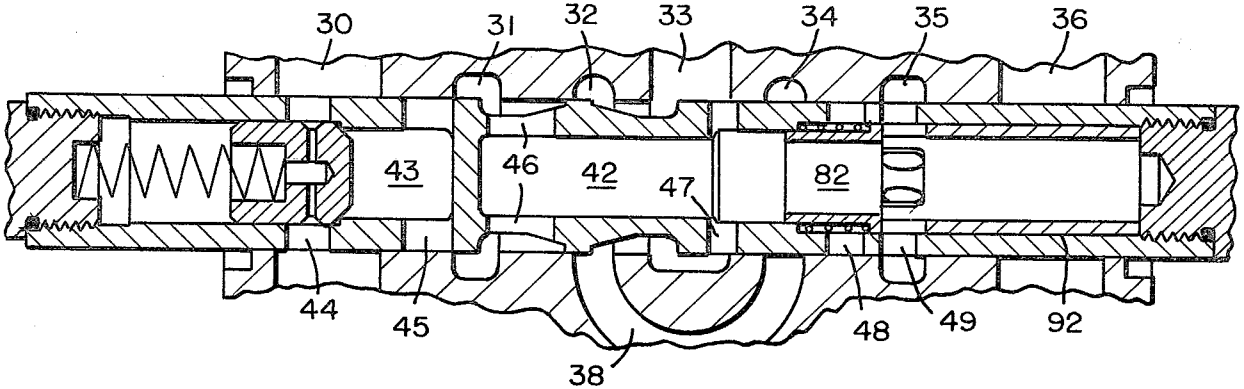
FIG. 4 is a view similar to FIG. 1, showing the valve element in its float position.

In the next case, assume that the operator desires to drop the bucket to the ground. Valve element 40 is shifted to the float position, as illustrated in FIG. 4 and referred to as the fourth position. At that time, the weight of the bucket pushes fluid from the head end of motor 22 through motor port 16, outer exhaust chamber 31, transverse passage 46, and into internal flow passage 42. The hydraulic fluid can then pass into the rod end of motor 22 via transverse passage 49, motor chamber 35, and second motor port 18. It should also be noted that internal flow passage 42 is in communication with central exhaust chamber 33 and supply chamber 32 via transverse passage 47. This restricted communication insures a positive pressure in the line on either side of motor 22 to prevent cavitation. By connecting the two sides of motor 22 to each other, as described hereinabove, the bucket floats down to the ground due to its own weight.

Figure 3:
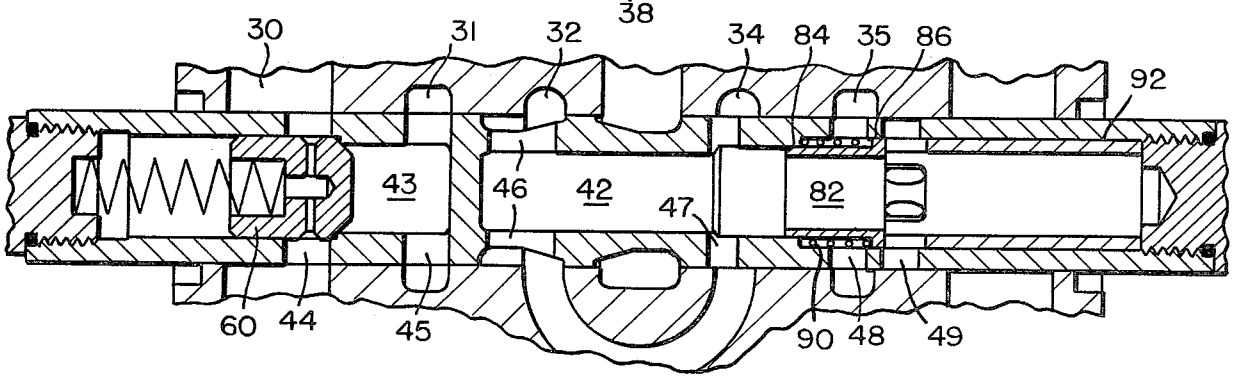
FIG. 3 is a view similar to FIG. 1, showing the valve element in its power down position.

Next, assume that the operator desires to perform a grading operation. Valve element 40 is placed in the power-down or third position so as to lower the bucket towards the ground. Referring to FIG. 3, note that fluid from the head end of motor 22 passes through motor chamber 31, across check valve 60, and into outer exhaust chamber 30. Simultaneously, fluid from pump 20 flows through supply chambers 32 and 34 into internal flow passage 42. Although a small pressure differential is developed across load check valve 82, outside diameter 86 provides a larger surface area than outside diameter 84, and hydraulic fluid is able to move check valve 82 against check spring 90 to permit flow through transverse passage 48, motor chamber 35, second motor port 18, and into the rod end of motor 22. As the fluid enters the rod end of motor 22, the bucket is forced towards the ground and the wheels of the vehicle may actually raise off from the ground.

Once the bucket is lowered to a desired position, the operator moves the valve element 40 back to the hold position. At the time the pressure in rod end 22 is transmitted to motor chamber 35 and acts in chamber 88. When valve element 40 has moved enough so that the force of fluid from supply chamber 34 acting against the outside diameter 86 of valve 82 is approximately the same as the force of motor chamber fluid in chamber 88 combined with the force of spring 90, check valve 82 closes and stops flow of hydraulic fluid from motor port 35 to central exhaust chamber 33 via passageway 46. Therefore, fluid remains in motor 22 and the bucket stays in its desired position.

As best seen in FIGS. 5 and 6, another feature of the present invention is sleeve member 92 which provides a stop for load check valve 82. A plurality of openings 100 cooperate with openings 102 in transverse passage 49 to allow flow between the interior of sleeve member 92 and passageway 36 irrespective of the relative position between sleeve member 92 and valve element 40. Thus, control valve 8 is easily assembled since no provision is required to orient sleeve member 92 with respect to valve element 40.

One skilled in the art will realize that there has been disclosed a hydraulic control valve which includes a load check valve for the power-down position, a float position without cavitation, increased ease of operation, and relative ease of assembly. Further a check valve has been disclosed which directs flow to either an outlet or a bypass opening.

While there has been described what is at present considered the preferred embodiment of the invention, it will be obvious to those skilled in the art that changes and modifications may be made therein without departing from the invention, and it is, therefore, aimed in the appended claims to cover all such changes and modifications as followed in the true spirit and scope of the invention.

What is claimed is:

1. In a hydraulic control valve comprising a housing having inlet and exhaust ports and first and second motor ports, passageways interconnecting said ports, and a shiftable valve element having an internal flow passage, said valve element having four operative positions for controlling flow through said passageways, a first position in which said inlet and exhaust ports are interconnected and each motor port is isolated from the other of said ports, second and third positions in which said inlet port is isolated from said exhaust port and is connected with said first and second motor ports, respectively, while the exhaust port is connected with said second and first motor ports, respectively, and a fourth position in which said two motor ports are interconnected, and this interconnection is in restricted communication with said exhaust port, a check valve in said internal flow passage for preventing flow from said first motor port to said exhaust port when said valve element is moved between the first and second positions to said first position, the improvement comprising:

valve means associated with said shiftable valve element for preventing fluid communication between said second motor port and said exhaust port when said shiftable valve element is moved from between the first and third positions.

2. The hydraulic control valve defined in claim 1, wherein said valve means includes a load check valve having a hollow center and a shoulder on a first end, a check spring between said shiftable valve element and said shoulder to bias said load check valve to prevent fluid communication between said shiftable valve element and said second motor port.

3. The hydraulic control valve defined in claim 2, wherein said load check valve has a larger surface area on said first end than on a second end to enable hydraulic fluid from said inlet port to act on said first end to open said load check valve against said check spring as said shiftable valve element is moved from said first position to said third position and thereby permits said hydraulic fluid to enter said second motor port, further when said shiftable valve element is being moved from said third position to said first position, hydraulic fluid from said second motor port acts against the shoulder portion contacting said check spring to close said load check valve against said inlet port hydraulic fluid and thereby stop hydraulic fluid from flowing from said second motor port to said exhaust port.

4. The hydraulic control valve defined in claim 3, further including a sleeve member located within said internal flow passage wherein one end of said sleeve member provides an abutment against which said first end of said load check valve is seated.

5. The hydraulic control valve defined in claim 4, wherein said shiftable valve element includes a plurality of openings that cooperate with a plurality of openings in said sleeve to permit hydraulic fluid to pass from an internal passage of said sleeve through at least a portion of said openings in said shiftable valve element to an exhaust passage irrespective of the position of said sleeve within said shiftable valve element.

6. The hydraulic control valve defined in claim 5, wherein said plurality of openings in said shiftable valve element are greater in number than said plurality of openings in said sleeve so that fluid may pass through said sleeve openings and said shiftable valve openings irrespective of the position of said sleeve with respect to said shiftable valve.

7. The hydraulic control valve defined in claim 6, wherein said check spring is a compression spring.

8. A hydraulic control valve comprising:

a. a housing containing a valve bore intersected by seven longitudinally spaced chambers, which include a central exhaust chamber, first and second outer exhaust chambers located on opposite sides of the central exhaust chamber, first and second motor chambers located, respectively, between the central exhaust chamber and the first and second outer exhaust chambers, and first and second supply chambers located, respectively, between the central exhaust chamber and the first and second motor chambers;

b. a shiftable valve element reciprocable in said valve bore and containing an internal passage and six spaced transverse passages which open through the outer peripheral surface of said shiftable valve element;

c. said shiftable valve element having a first position in which it isolates each motor chamber from the other of said chambers and connects the supply chambers with the central exhaust chamber, a second position in which the first and second transverse passages register, respectively, with said first motor and said first supply chambers, and the fourth and sixth transverse passages register with said second motor chamber and with said central and second outer exhaust chamber, respectively, and means carried by said valve element to isolate said central exhaust chamber from said supply chambers, a third position in which said first and second transverse passages register, respectively, with said first outer exhaust and first motor chambers, and the fourth and fifth transverse passages register with the second supply chamber and the second motor chamber, respectively, and means carried by said valve element to isolate said central exhaust chamber from said supply chambers, a fourth position in which said third and sixth transverse passages register with said first and second motor chambers, respectively, as well as with each other via the internal passage of said valve element and said fourth transverse passage connects said internal flow passage to said central exhaust chamber to bleed off any excess hydraulic fluid;

d. a spring bias check valve located in the internal flow passage of said valve element and arranged to prevent fluid communication between said first motor chamber and said central exhaust chamber when said valve element is moved between said first and second positions; and e. valve means associated with said shiftable valve element for preventing fluid communication between said second motor chamber and said central exhaust chamber when said shiftable valve element is moved between said first and third positions.

9. The hydraulic control valve defined in claim 8, wherein said valve means includes a load check valve having a hollow center and a shoulder on a first end, a check spring between said shiftable valve element and said shoulder biases said load check valve to close said fifth transverse passage and thereby prevent hydraulic fluid from flowing through said shiftable valve element to said second motor chamber.

10. The hydraulic control valve defined in claim 9, wherein said load check valve has a larger surface area on said first end than on said second end to enable hydraulic fluid from said second supply chamber to act on said first end to open said load check valve against said check spring as said shiftable valve element is moved from said first position to said third position and thereby permits said hydraulic fluid to enter said fifth transverse passage in said shiftable valve element and flow into said second motor chamber, further when said shiftable valve element is moved from said third position to said first position, hydraulic fluid from said second motor chamber acts against said shoulder portion contacting said check spring to close said load check valve against said supply chamber hydraulic fluid and thereby close said fifth transverse passage and thus stop hydraulic fulid flow from said second motor port to said central exhaust chamber via said third transverse passage.

11. The hydraulic control valve defined in claim 10, further including a sleeve member located within said internal flow passage so that one end of said sleeve member provides an abutment against which said first end of said load check valve is seated.

12. The hydraulic control valve defined in claim 11, wherein said sleeve member has a plurality of fingers defining a plurality of openings adjacent said first end, said fingers being aligned with said sixth transverse passage to permit fluid to flow from said supply chambers through said sleeve member and into said sixth transverse passage when said load check valve is covering said fifth transverse passage.

13. The hydraulic control valve defined in claim 12, wherein said sixth transverse passage includes a plurality of openings that cooperate with said plurality of openings in said sleeve, said plurality of sixth transverse passage openings being greater in number than said plurality of sleeve openings so that fluid may pass through said sleeve openings and said six transverse passage openings irrespective of the position of said sleeve with respect to said transverse passage openings.

14. The hydraulic control valve defined in claim 13, wherein said check spring is a compression spring.

* * * * *